US006513869B1

(12) United States Patent
Wu

(10) Patent No.: US 6,513,869 B1
(45) Date of Patent: Feb. 4, 2003

(54) COMBINED BABY WALKER/ROCKING CHAIR

(76) Inventor: Tsai-Mei Wu, No. 243, Hwa Tzung Road, Hsueh Chia Town, Tainan Hsien (TW)

( * ) Notice: Subject to any disclaimer, the term of this patent is extended or adjusted under 35 U.S.C. 154(b) by 0 days.

(21) Appl. No.: 10/041,444

(22) Filed: Jan. 10, 2002

(51) Int. Cl.[7] ..... A47C 13/00
(52) U.S. Cl. ..... 297/130; 297/271.6; 297/5
(58) Field of Search ..... 297/258.1, 271.5, 297/5, 131, 130, 271.6; 280/43, 43.11, 887.051, 43.24, 43.14

(56) References Cited

U.S. PATENT DOCUMENTS 174,793 A * 3/1876 Erikson
1,674,741 A * 6/1928 Rosman
2,716,439 A * 8/1955 Feist
3,041,081 A * 6/1962 Lott
4,822,030 A * 4/1989 Cone
5,636,853 A * 6/1997 Huang
5,845,963 A * 12/1998 Huang

* cited by examiner

*Primary Examiner*—Milton Nelson, Jr.
(74) *Attorney, Agent, or Firm*—Charles E. Baxley

(57) ABSTRACT

A combined baby walker/rocking chair comprises a chassis, a support, an upper frame, and a seat. The chassis and the upper frame are connected via the support. Two parallel transverse beams are mounted to a lower end of the support. Plural casters are mounted to an underside of the chassis. The chassis comprises two symmetric arcuate frames and two control devices that are constructed to allow a baby walker to be converted into a rocking chair, and vice versa, while providing a stable structure.

4 Claims, 8 Drawing Sheets

COMBINED BABY WALKER/ROCKING CHAIR

BACKGROUND OF THE INVENTION

1. Field of the Invention

The present invention relates to a combined baby walker/rocking chair. In particular, the present invention relates to a baby walker that can be converted into a rocking chair, and vice versa, while providing a stable structure.

2. Description of the Related Art

FIG. 9 of the drawings illustrates a conventional baby walker that may help a baby to learn how to walk. The baby walker comprises a chassis 1', a cross-hinged support 2', an upper frame 3', and a seat 4'. The chassis 1' is substantially an annular or rectangular member having plural casters 11' attached to an underside thereof for allowing movement of the baby walker. The cross-hinged support 2' provides a connection between the chassis 1' and the upper frame 3'. The upper frame 3' is substantially annular and the seat 4' is located in a central portion of the upper frame 3'. Thus, a baby may sit comfortably in the seat 4' without the risk of falling to the ground. The baby walker is limited in use and function.

SUMMARY OF THE INVENTION

An object of the present invention is to provide a baby walker that can be converted into a rocking chair, and vice versa, while providing a stable structure.

A combined baby walker/rocking chair in accordance with the present invention comprises:

a chassis, a support, an upper frame, and a seat, the chassis and the upper frame being connected via the support, two parallel transverse beams being mounted to a lower end of the support, plural casters being mounted to an underside of the chassis, the improvements comprising:

the chassis comprising two symmetric arcuate frames and two control means, each said arcuate frame comprising a first notch in an inner side wall thereof through which an associated one of the transverse beams extends, each said arcuate frame further comprising a peg and a second notch in an outer side thereof;

each said control means comprising a positioning block, a control block, and a spring, each said positioning block being pivotally mounted to the chassis, each said positioning block comprising an engaging section for secure engagement with an associated one of the transverse beams, each said positioning block further comprising a positioning hole;

each said control block comprising an insertion section configured corresponding to a shape of the positioning hole of the respective positioning block such that rotation of the positioning block is prevented when the insertion section of the control block is inserted into the positioning hole, each said control block further comprising a pivot hole for pivotally receiving an associated one of the pegs, each said control block further comprising a grip portion on an outer edge thereof;

each said spring being mounted around an associated one of the pegs and attached to the chassis and an associated one of the control blocks;

wherein when the arcuate frames are located parallel to each other, the control blocks are biased by the springs such that the insertion section of each said control block is inserted into the positioning hole of the respective positioning block to thereby retain the arcuate frames in a horizontal plane, thereby constructing a baby walker; and wherein when the control blocks are moved laterally away from the chassis, the insertion section of each said control block is disengaged from the positioning hole of the respective positioning block to thereby allow the arcuate frames to respectively pivot about the pegs until the insertion section of each said control block is re-inserted into the positioning hole of the respective positioning block, thereby constructing a rocking chair.

Each of the arcuate frames includes an engaging groove in a first end thereof and an engaging member in a second end thereof. The engaging groove of one of the arcuate frames is engaged with the engaging member of the other arcuate frame.

Each arcuate frame further comprises an engaging section that defines a first engaging groove. Each control means comprises a lid secured to an associated one of the arcuate frames, the lid comprising a second engaging groove. The first engaging groove and the second engaging groove together define a hole for pivotally receiving an associated one of the positioning blocks.

Each control block comprises a stop on an outer side thereof for limiting a maximum rocking angle of the rocking chair constructed from the combined baby walker/rocking chair.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
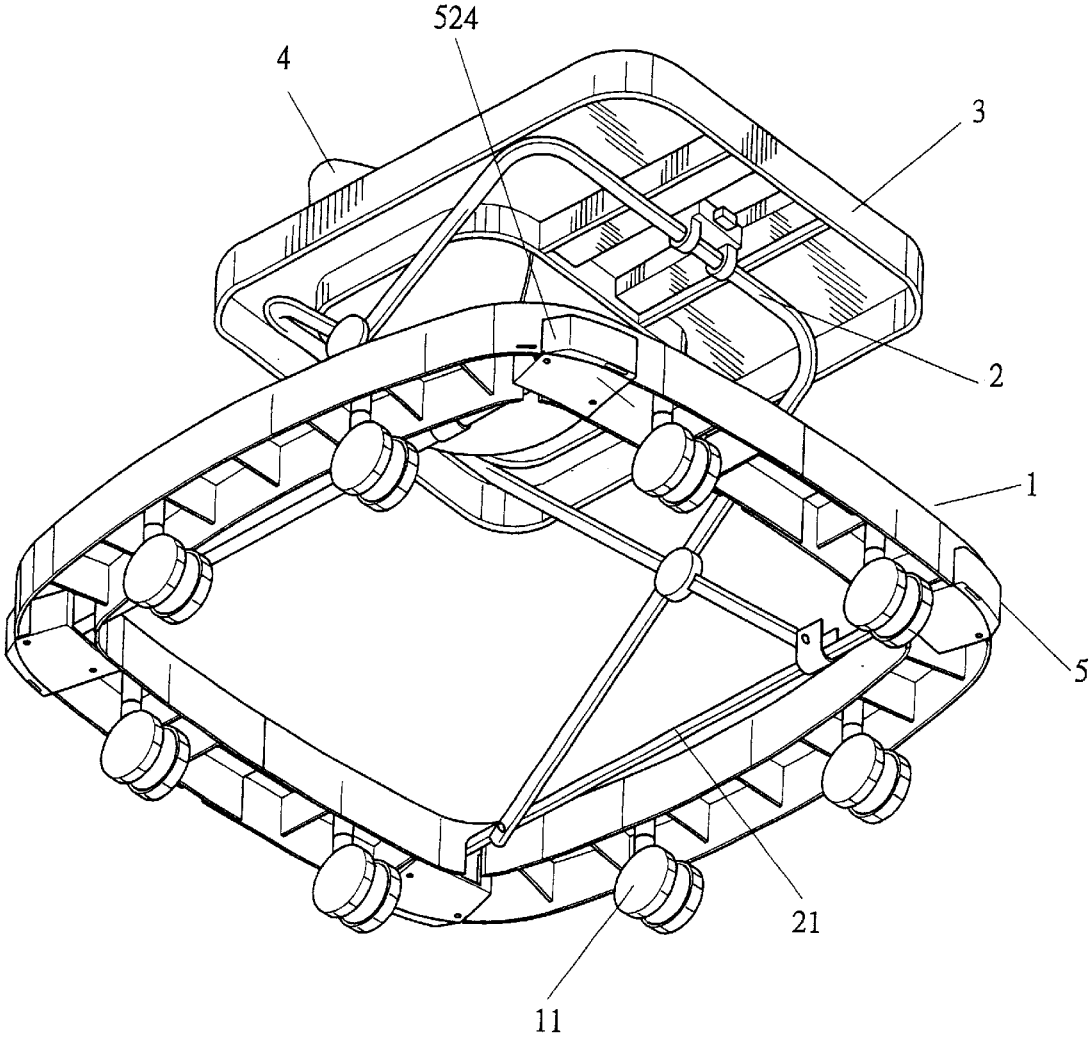
FIG. 1 is a perspective view of a combined baby walker/rocking chair, assembled to a baby walker, in accordance with the present invention.
Figure 2:
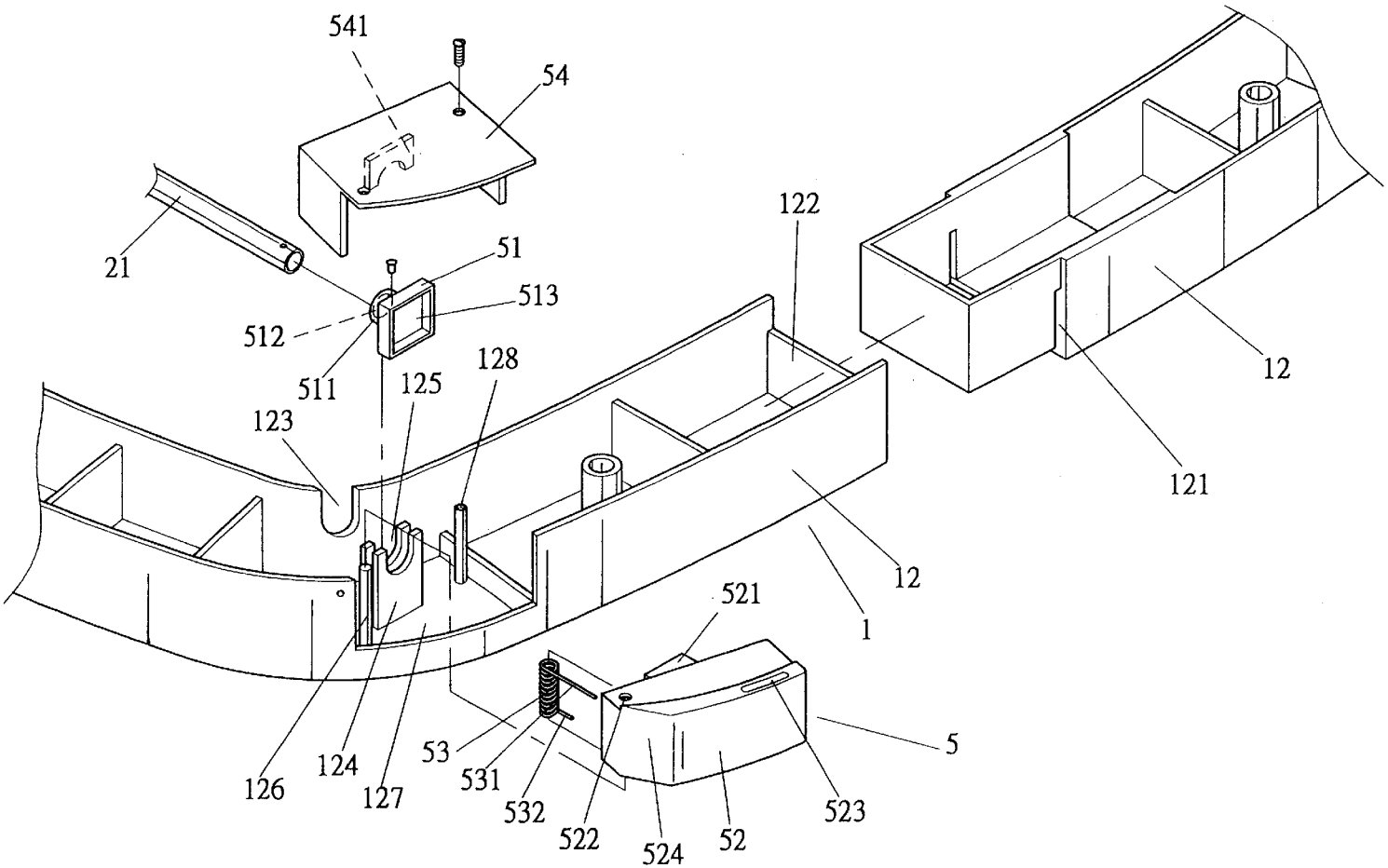
FIG. 2 is an exploded perspective view of a portion of a chassis of the comined baby walker/rocking chair in accordance with the present invention.
Figure 3:
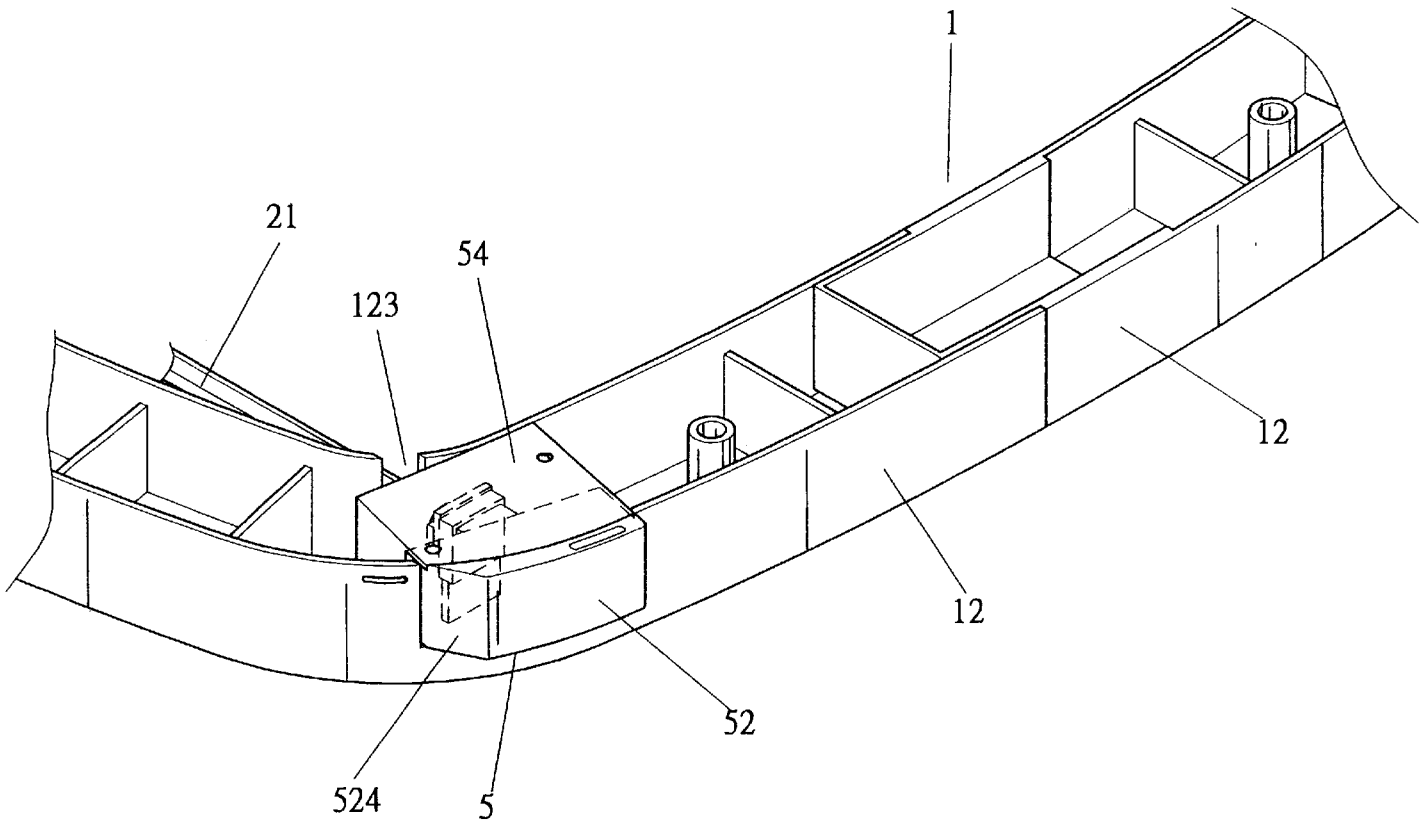
FIG. 3 is a perspective view of the portion of a chassis of the combined baby walker/rocking chair in FIG. 2.
Figure 4:
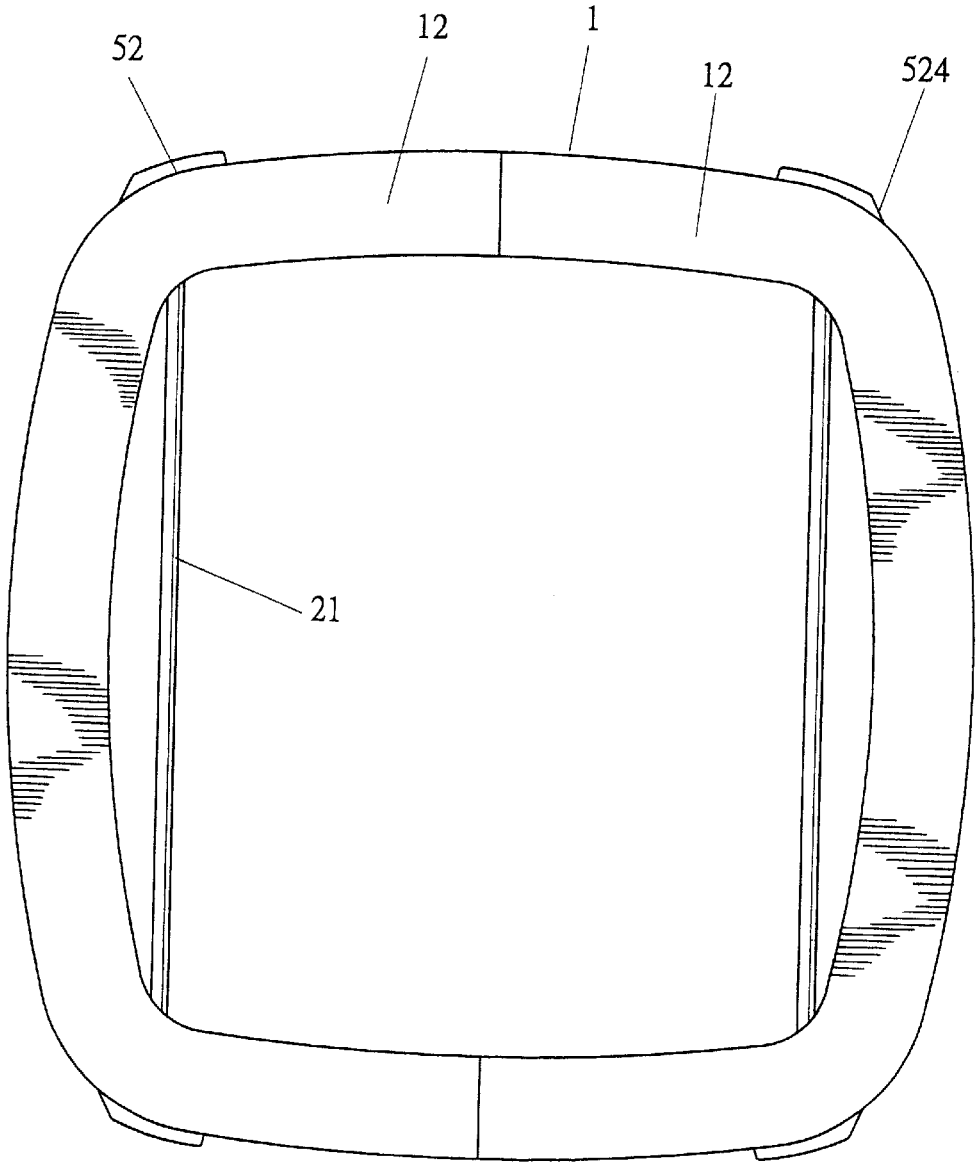
FIG. 4 is a top view of the combined baby walker/rocking chair in accordance with the present invention.
Figure 5:
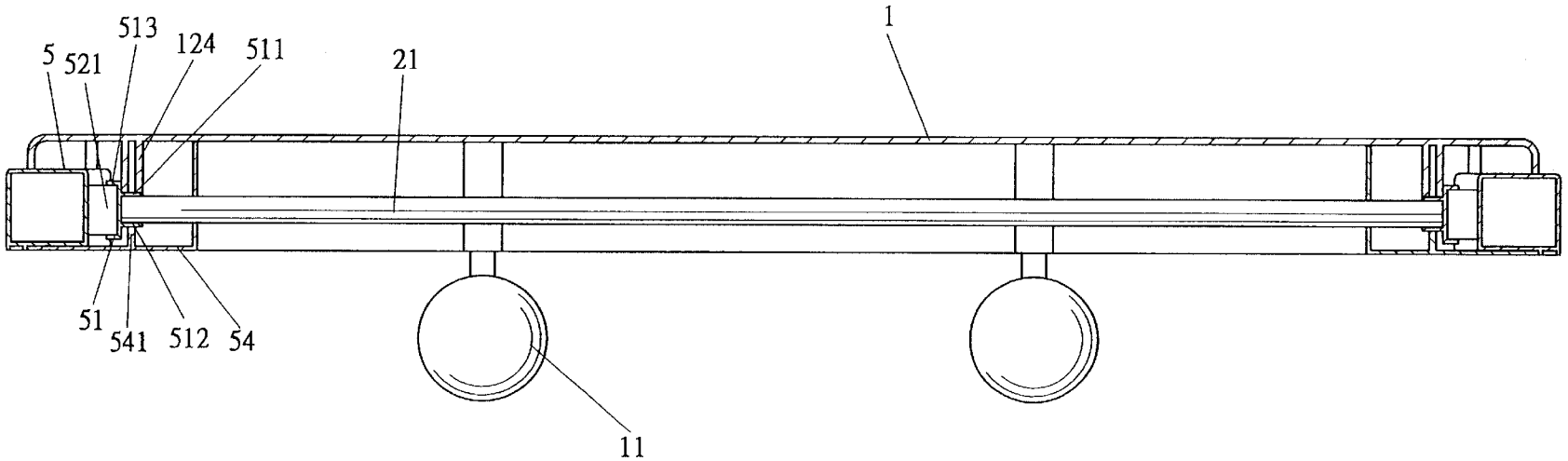
FIG. 5 is a sectional side view of the combined baby walker/rocking chair in accordance with the present invention.

Referring to FIGS. 1 through 5, a baby walker in accordance with the present invention generally comprises a chassis 1, a support 2, an upper frame 3, and a seat 4. The chassis 1 and the upper frame 3 are connected via the support 2. Two parallel transverse beams 21 are mounted to a lower end of the support 2 that is preferably a cross-hinged device. Plural casters 11 are mounted to an underside of the chassis 1.

The chassis 1 comprises two symmetric arcuate frames 12 and two control means 5. One of the arcuate frames 12 includes an engaging groove 121 in an end thereof and an engaging member 122 in the other end thereof for respectively engaging with an engaging groove 121 and an engaging member 122 of the other arcuate frame 12. Each arcuate frame 12 further comprises a notch 123 in an inner side wall thereof through which the respective transverse beam 21 extends. Mounted between the inner side wall and an outer side wall of each arcuate frame 12 is an engaging section 124 which faces the notch 123. An arcuate engaging groove 125 is defined in the engaging section 124. Also mounted between the inner side wall and the outer side wall of each arcuate frame 12 and located on a side of the engaging section 124 is a peg 126. A further notch 127 is defined in the outer side wall of each arcuate frame 12. An engaging hole 128 is defined in each arcuate frame 12, which will be described later.

Each control means 5 comprises a positioning block 51 mounted to an associated engaging section 124, a control block 52, a spring 53, and a lid 54 engaged with an associated engaging hole 128. The positioning block 51 comprises an engaging section 511 having an engaging hole 512 for secure engagement with a transverse beam 21 of the support 2, and a positioning hole 513 is in a side of the positioning block 51 that faces away from the engaging groove 512.

The control block 52 comprises an insertion section 521 configured corresponding to a shape of the positioning hole 513 of the positioning block 51 such that rotation of the positioning block 51 is prevented when the insertion section 521 of the control block 52 is inserted into the associated positioning hole 513. The control block 52 further comprises a pivot hole 522 in a side thereof for rotatably receiving the peg 126. A grip portion 523 is provided on an outer edge of the control block 52, and a stop 524 is provided on a side of the outer edge of the control block 52 to limit the maximum rocking angle of the baby walker/rocking chair.

The spring 53 is mounted around the peg 126 and comprises two ends 531 and 531 that are respectively attached to the chassis 1 and the control block 52. The lid 54 comprises an arcuate engaging groove 541 corresponding to the positioning block 51 and is fixed to the chassis 1 via fasteners such that the engaging groove 125 of the chassis 1 and the engaging groove 541 of the lid 54 together define a hole for receiving the engaging section 511 of the positioning block 51.

When forming a baby walker, the arcuate frames 12 are engaged with each other to form the chassis 1. Each control block 52 is biased by a respective spring 53 such that the insertion section 521 of the control block 52 is securely engaged with the positioning hole 513 of the respective positioning block 51. Thus, the arcuate frames 12 are positioned in a horizontal plane, thereby providing a stable chassis 1.

Figure 6:
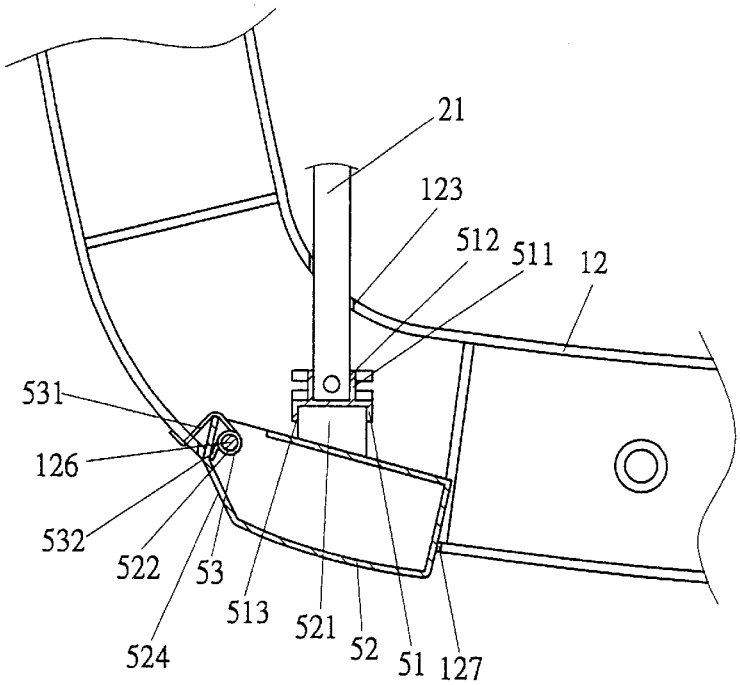
FIG. 6 is a sectional view of the portion of a chassis of the combined baby walker/rocking chair in FIG. 2.
Figure 7:
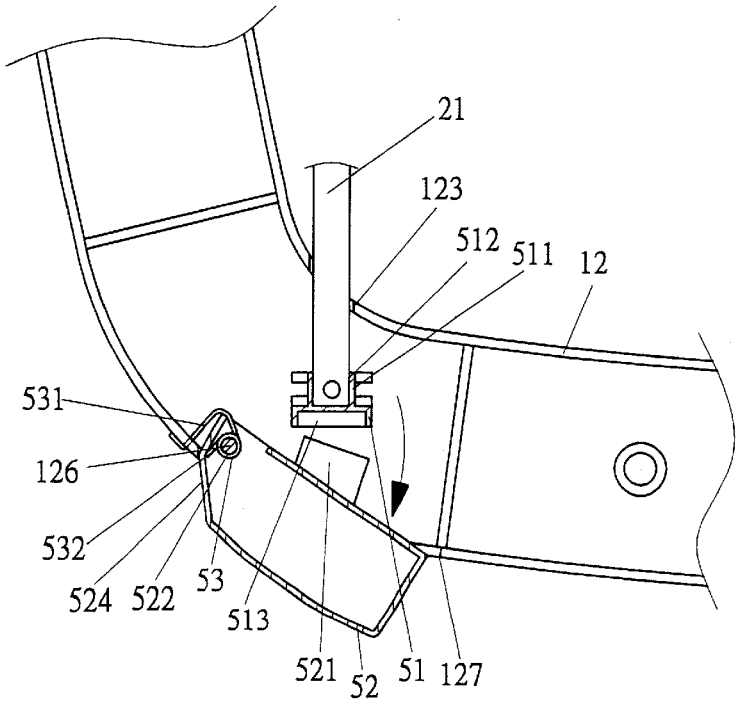
FIG. 7 is a view similar to FIG. 6, illustrating adjustment of the combined baby walker/rocking chair in accordance with the present invention.
Figure 8:
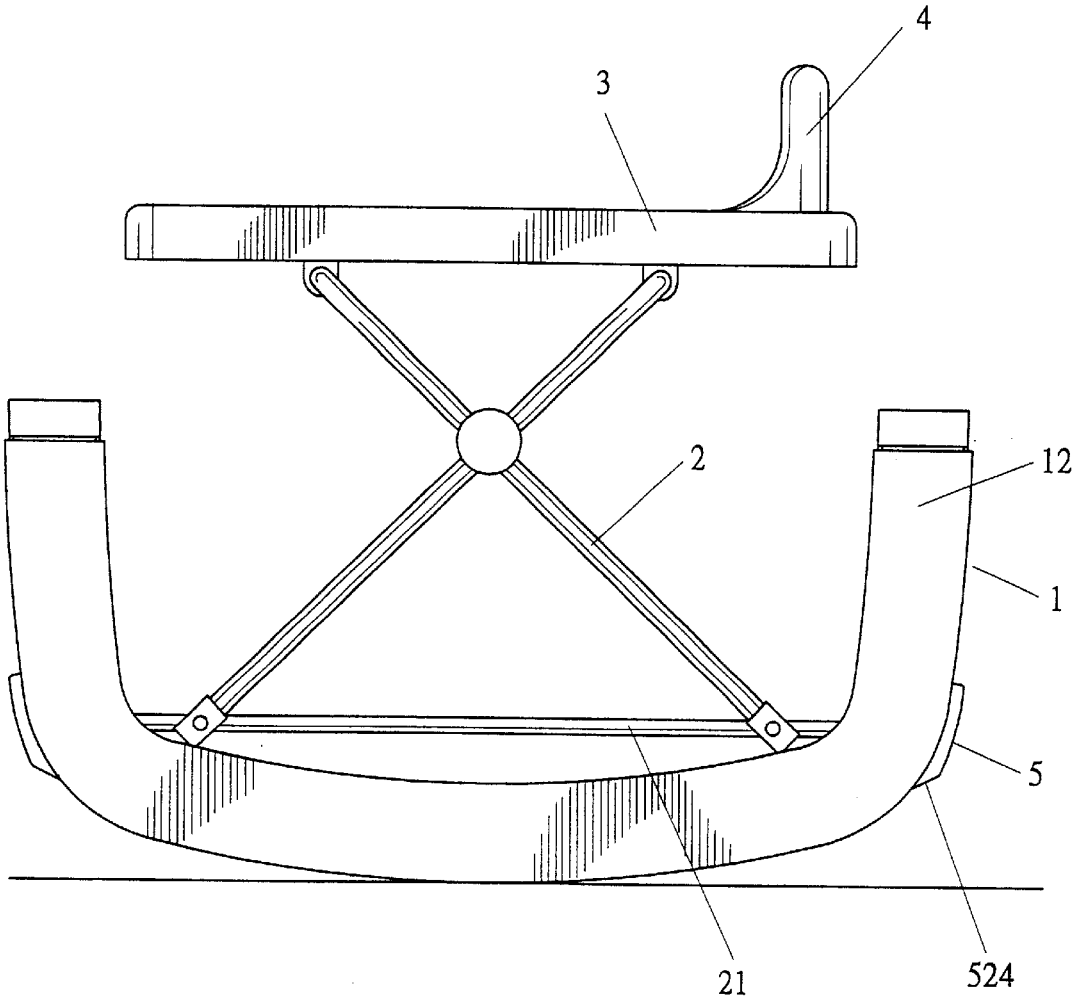
FIG. 8 is a side view of the combined baby walker/rocking chair that has been bled to a rocking chair.
Figure 9:
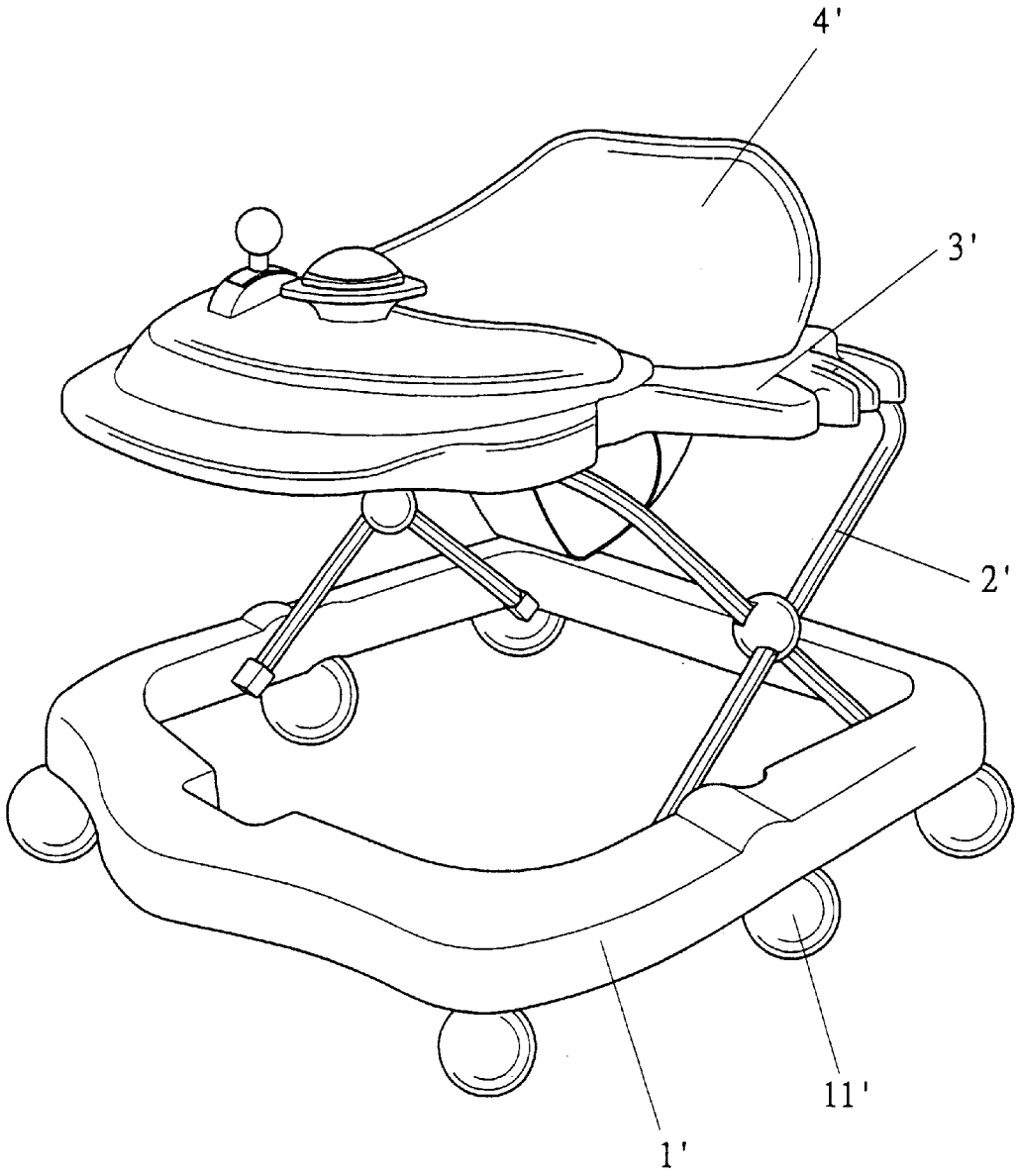
F I G . 9(PRIOR ART)
FIG. 9 is a perspective view of a conventional baby walker.

When each control block 52 is moved from a position shown in FIG. 6 to a position shown in FIG. 7, the insertion section 521 of the control block 52 is disengaged from the respective positioning hole 513. Next, each arcuate frame 12 is pivoted about the respective transverse rod 21 until the control block 52 is biased by the respective spring 53 such that the insertion section 521 is re-inserted into and thus retained in the respective positioning hole 513. Thus, a rocking chair is formed, as shown in FIG. 8. The stops 524 limit the maximum rocking angle of the rocking chair to thereby provide improved operational safety.

According to the above description, it is appreciated that the baby walker constructed from the combined baby walker/rocking chair in accordance with the present invention provides an improved stability for the baby by means of engagement between the engaging members 122 and the engaging grooves 121 of the frames 12 of the chassis 1. The baby walker can be converted into a rocking chair by means of operating the control blocks 52. In addition, such conversion can be accomplished easily and quickly by means of engagement between the insertion section 521 of each control block 52 and the positioning hole 513 of the respective positioning block 51. And the resultant rocking chair is stable.

Although the invention has been explained in relation to its preferred embodiment, it is to be understood that many other possible modifications and variations can be made without departing from the scope of the invention as hereinafter claimed.

What is claimed is:

1. A combined baby walker/rocking chair, comprising:

a chassis, a support, an upper frame, and a seat, the chassis and the upper frame being connected via the support, two parallel transverse beams being mounted to a lower end of the support, plural casters being mounted to an underside of the chassis, the improvements comprising:

the chassis comprising two symmetric arcuate frames and two control means, each said arcuate frame comprising a first notch in an inner side wall thereof through which an associated one of the transverse beams extends, each said arcuate frame further comprising a peg and a second notch in an outer side thereof;

each said control means comprising a positioning block, a control block, and a spring, each said positioning block being pivotally mounted to the chassis, each said positioning block comprising an engaging section for secure engagement with an associated one of the transverse beams, each said positioning block further comprising a positioning hole;

each said control block comprising an insertion section configured corresponding to a shape of the positioning hole of the respective positioning block such that rotation of the positioning block is prevented when the insertion section of the control block is inserted into the positioning hole, each said control block further comprising a pivot hole for pivotally receiving an associated one of the pegs, each said control block further comprising a grip portion on an outer edge thereof;

each said spring being mounted around an associated one of the pegs and attached to the chassis and an associated one of the control blocks;

wherein when the arcuate frames are located parallel to each other, the control blocks are biased by the springs such that the insertion section of each said control block is inserted into the positioning hole of the respective positioning block to thereby retain the arcuate frames in a horizontal plane, thereby constructing a baby walker; and wherein when the control blocks are moved laterally away from the chassis, the insertion section of each said control block is disengaged from the positioning hole of the respective positioning block to thereby allow the arcuate frames to respectively pivot about the pegs until the insertion section of each said control block is re-inserted into the positioning hole of the respective positioning block, thereby constructing a rocking chair.

2. The combined baby walker/rocking chair as claimed in claim 1, wherein each of the arcuate frames includes an engaging groove in a first end thereof and an engaging member in a second end thereof, the engaging groove of one of the arcuate frames being engaged with the engaging member of the other arcuate frame.

3. The combined baby walker/rocking chair as claimed in claim 1, wherein each said arcuate frame further comprises an engaging section that defines a first engaging groove, each said control means comprising a lid secured to an associated one of the arcuate frames, the lid comprising a second engaging groove, the first engaging groove and the second engaging groove together defining a hole for pivotally receiving an associated one of the positioning blocks.

4. The combined baby walker/rocking chair as claimed in claim 1, wherein each said control block comprises a stop on an outer side thereof for limiting a maximum rocking angle of the rocking chair constructed from the combined baby walker/rocking chair.

* * * * *